US007731169B2

(12) United States Patent
Saito

(10) Patent No.: US 7,731,169 B2
(45) Date of Patent: Jun. 8, 2010

(54) SHEET FINISHING APPARATUS

(75) Inventor: Takashi Saito, Fuefuki (JP)

(73) Assignee: Nisca Corporation, Minamikoma-gun (JP)

( * ) Notice: Subject to any disclaimer, the term of this patent is extended or adjusted under 35 U.S.C. 154(b) by 590 days.

(21) Appl. No.: 11/613,428

(22) Filed: Dec. 20, 2006

(65) Prior Publication Data

US 2007/0145674 A1 Jun. 28, 2007

(30) Foreign Application Priority Data

Dec. 28, 2005 (JP) ..... 2005-379992

(51) Int. Cl.
*B65H 37/04* (2006.01)

(52) U.S. Cl. ..... 270/58.12; 270/58.02; 270/58.07; 270/58.08; 270/58.11; 270/58.17

(58) Field of Classification Search ..... 270/58.02, 270/58.07, 58.08, 58.11, 58.12, 58.17; 271/220
See application file for complete search history.

(56) References Cited

U.S. PATENT DOCUMENTS 5,478,062 A * 12/1995 Horiuchi et al. ..... 270/58.08
5,662,322 A * 9/1997 Kawaguti ..... 271/84
2006/0208411 A1* 9/2006 Saito et al. ..... 270/58.07
2006/0279037 A1* 12/2006 Kushida et al. ..... 270/58.08

* cited by examiner

*Primary Examiner*—Gene Crawford
*Assistant Examiner*—Leslie A Nicholson, III
(74) *Attorney, Agent, or Firm*—Judge Patent Associates

(57) ABSTRACT

Sheet finishing apparatus constructed to prevent sheet skewing during stacking conveyance, and stack-disarranging sheet slippage. A sheet-stacking tray is disposed forming a break in a discharge path below a discharge outlet. A first discharge roller unit is disposed at the discharge outlet, and a second discharge roller unit is arranged to convey, in cooperation with the first discharge roller unit, sheets downstream to the stacking tray. The second discharge roller unit is supported allowing it to rise and lower between an engage position where it catches sheet(s) on the storage tray, and a retracted position. A registering wall is provided in the stacking tray, for positionally registering the leading/trailing edge of the sheets. A gripper pressingly holds the uppermost sheet stacked on the storage tray, and a controller controls the movement of the gripper between an operational position where it engages the uppermost sheet, and a non-operational retract position.

4 Claims, 8 Drawing Sheets

SHEET FINISHING APPARATUS

BACKGROUND OF THE INVENTION

1. Technical Field

The present invention relates to sheet finishing apparatuses that stack/store sheets sequentially conveyed out from a printer, a copier, a printing machine or other device; more particularly the invention relates to sheet finishing apparatuses for receiving sheets on which images have been formed by an image forming apparatus, and carrying out stapling, punching or stamping processes on the sheets.

2. Description of the Related Art

Generally, these kinds of sheet finishing apparatuses temporarily set onto a tray sheets on which images have been formed by an image forming apparatus, etc. After the sheets set on the tray have been finish-processed, the finished sheets are held in a downstream storage tray. In the finishing tray, depending on the process, the sheets are finished by being placed on the tray one at a time to undergo a stamping process, or a ream of sheets is placed on the tray in a bundle to undergo a stapling process. This means that the finishing tray requires a conveyance mechanism for bringing in sheets, and a conveyance mechanism for sending out finished sheets to the storage tray.

Conventionally, as a conveying-in mechanism for conveying in sheets to a finishing tray, a system wherein conveyance rollers are provided at a sheet-discharge outlet of a discharge path for ejecting sheets onto a tray arranged forming a break in the path on the downstream side of the discharge outlet, and a system wherein sheets are conveyed out by the cooperation of a first discharge roller provided at a discharge outlet, and a second discharge roller arranged on a tray are both known. While the former system affords a simple structure, the downside is that sheets can become skewed or otherwise misaligned. A known problem with the latter is that sheets can become wrinkled or otherwise damaged if the timing at which the second discharge roller on the tray engages the sheets being fed by the first discharge roller is off.

Meanwhile, as a conveyance mechanism for discharging sheets from a finishing tray, a mechanism such as that disclosed in Japanese Unexamined Pat. App. Pub. No. 2003-128332, for example, is known, in which a claw-shaped projecting member is provided for engaging the trailing edge of the sheets on the finishing tray, and the projecting member is shifted along the finishing tray to convey sheets out toward a stacking tray. Specifically, a long groove is provided in the midportion of the finishing tray, reaching from the sheet-inflow side to the sheet convey-out side. The claw-shaped projecting member is disposed in the long groove to project above the tray through the tray back side (the reverse side), and is fastened to an endless belt provided along the tray back side. Pulleys for the endless belt are drivingly rotated. Pressing on the trailing edge of the sheets with a claw-shaped member in this way enables the accurate conveyance to the storage tray of weighty sheets stacked in a bundle. It also makes it possible to neatly convey the sheets out in bundle form.

A further example of such conveyance mechanisms is a system, proposed for example in Japanese Unexamined Pat. App. Pub. No. 2002-193515 among other publications, in which, along with a sheet pushing mechanism for pushing out the trailing edge of the sheets, conveyance rollers are disposed at the discharge-outlet end of the conveyance path. According to this configuration, a claw-shaped projecting member is arranged on the finishing tray, free to travel along the convey-out direction, and a conveyance roller is arranged on the downstream side of the tray to convey out sheets. Sheets set on the finishing tray are pushed out by the claw-shaped projecting member and are then conveyed out by the conveyance roller. In other words, the claw-shaped projecting member pushes the sheets along the tray and downstream, and thereafter the conveyance roller, arranged at the discharge outlet on the downstream side, separated from the claw-shaped projecting member, takes over to convey the sheets.

With such structures known to date, in which sheets are ejected onto a tray with a discharge roller at the discharge outlet, sheets can become skewed and stacked out of alignment on the tray, or stray outside the tray in implementations in which, as described above, sheets are stacked in a finishing tray, with a break in the path from the discharge outlet being formed as described above. This means that, particularly when carrying out stapling or other finishing processes, with the sheets becoming unaligned, there will be problems inviting mishandling of the sheets. Likewise, a problem with implementations in which roller means at the discharge outlet and roller means on the tray cooperate to discharge sheets, as is disclosed in the above-cited App. Pub. No. 2002-193515, is that in rotating while pressing the sheet, the roller means arranged on the tray transfers in the sheet-discharging direction the lead sheet already stacked in a predetermined position, giving rise to displacement.

Sheets already stacked on the tray slipping out of place due to subsequent sheets being conveyed into the tray can invite erroneous finishing operations in the same manner as with the situations described above. With (flimsy) sheets lacking stiffness, such displacement is the cause of corners getting bent or folded. Particularly, in implementations in which a forward/reverse rotating roller means is provided on the stacking tray, and sheets are switched back from the discharge outlet and brought into alignment by their trailing edges landing against a registration member, at the same time that the above-described problems are brought about when sheets are conveyed in, a problem arises in which, in switching-back sheets with the roller means to bring the sheets into alignment, sheets that have been stacked may get dragged along and bend or fold at the leading edges.

BRIEF SUMMARY OF THE INVENTION

In view of the aforementioned issues, an object of the present invention is to make available a simple and low-cost sheet finishing apparatus that does not lead to skewing of sheets when the sheets are conveyed to a stacking tray, nor to any slipping out of place that disarranges stacked sheets. Another object of the present invention is to make available a sheet finishing apparatus capable of accurately finish-processing stacked sheets without inviting sheet displacement in aligning the sheet trailing edges into a registration position at the same time the sheets are conveyed into a tray with correct posture using forward and reverse driver rollers disposed on the tray.

The present invention employs the following configuration to attain the objects described above. A discharge path for sequentially discharging sheets printed by an image forming apparatus, for example, and a stacking tray for stacking sheets formed at a level difference with the discharge outlet of this path are arranged. A first discharge roller means is arranged at the discharge outlet of the discharge path, and a second discharge roller means is arranged at a downstream side to cooperate with the first discharge roller for conveying sheets in the direction of a sheet discharged to a stacking tray. The second discharge roller means is supported by a raise/lower support means that rises and lowers between an engaging position to engage sheets on the stacking tray and a retracted position. A registration means is also provided on the stacking tray to align the positions of the leading edge or the trailing edge of the sheets in the conveyance direction. This configuration disposes a grip means that pressingly holds the uppermost sheet stacked on the storage tray and grip control means for controlling the movement of the grip means between an operating position to touch the uppermost sheet, and a non-operating position retracted therefrom. The grip control means controls the grip means to be positioned at the operating position when the second discharge roller means cooperates with the first discharge roller means to convey a sheet downstream in a discharge direction. In this way, sheets coming from the discharge outlet are conveyed out to a predetermined position on the tray without skewing, while being engaged and controlled by the first discharge roller and the second discharge roller. At this time, sheets that have already been stacked on the tray are pressingly held by the grip means, so they do not become incorrectly aligned.

A sheet transport means for conveying stacked sheets to a downstream storage tray is composed of a sheet ejecting member that reciprocatingly moves along the stacking tray. A drive source for reciprocating movement of the sheet ejecting member, and a drive source for moving the grip means between an operating position and a non-operating position are composed of the same drive motor, and control means of the drive motor composes the grip control means. This makes it possible to compose a simple drive mechanism and its control.

Furthermore, the grip means is interlocked to the reciprocating movement of the sheet ejecting member to move between an operating position and a non-operating position. For example, the grip means moves from an operating position to a non-operating position by being interlocked to the reciprocating movement of the sheet ejecting member, and the sheet ejecting member is interlocked to convey sheets out from the tray. This makes it possible to configure a simpler drive mechanism.

Also, a registration means is arranged on the stacking tray at a position to align the trailing edge of the sheets in the discharge direction. Sheets on the stacking tray are switched back to be aligned at the alignment means. A sheet finishing means for finishing sheets aligned in position at the registration means, such as by stapling is arranged at the stacking tray, and sheet transport means for conveying out finished sheets to a downstream storage tray is arranged. The sheet transport means is configured by the sheet ejecting member that reciprocatingly moves along the stacking tray. After the grip means that pressingly holds the sheets on the tray moves from the operating position to the non-operating position during the reciprocating movement of the sheet ejecting member, the sheet ejecting member engages the trailing edges of the sheets to move them. This makes it possible to configure a compact finishing apparatus, such as a stapler.

BRIEF DESCRIPTION OF THE SEVERAL VIEWS OF THE DRAWINGS

FIG. 4 illustrates operational states in which a sheet is being conveyed into the finishing tray, wherein

FIG. 5 illustrates operating states in which a sheet is being conveyed into the finishing tray, wherein

FIG. 6 illustrates operating states in which a sheet is being conveyed into the finishing tray, wherein

FIG. 7 illustrates operating states in which a sheet processed in the finishing tray is being conveyed out to the storage tray, wherein

DETAILED DESCRIPTION OF THE INVENTION

A preferred embodiment of a sheet feeding apparatus and image reading apparatus according to the present invention will be explained based on the drawings provided.

Figure 1:
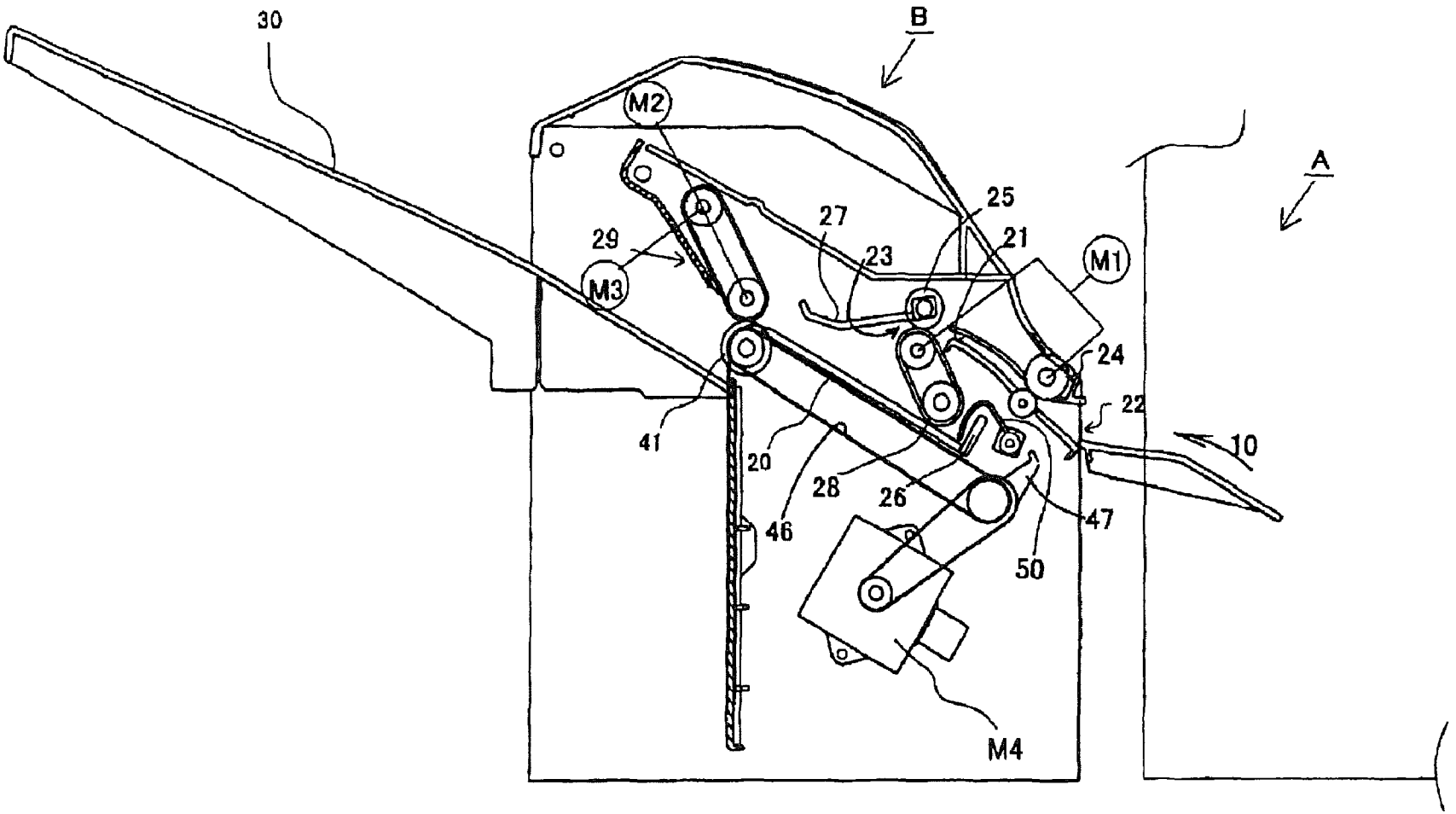
FIG. 1 is an overall configurational diagram representing a finish-processing apparatus (finisher) into which the present invention has been adopted, in an image forming apparatus.
Figure 2:
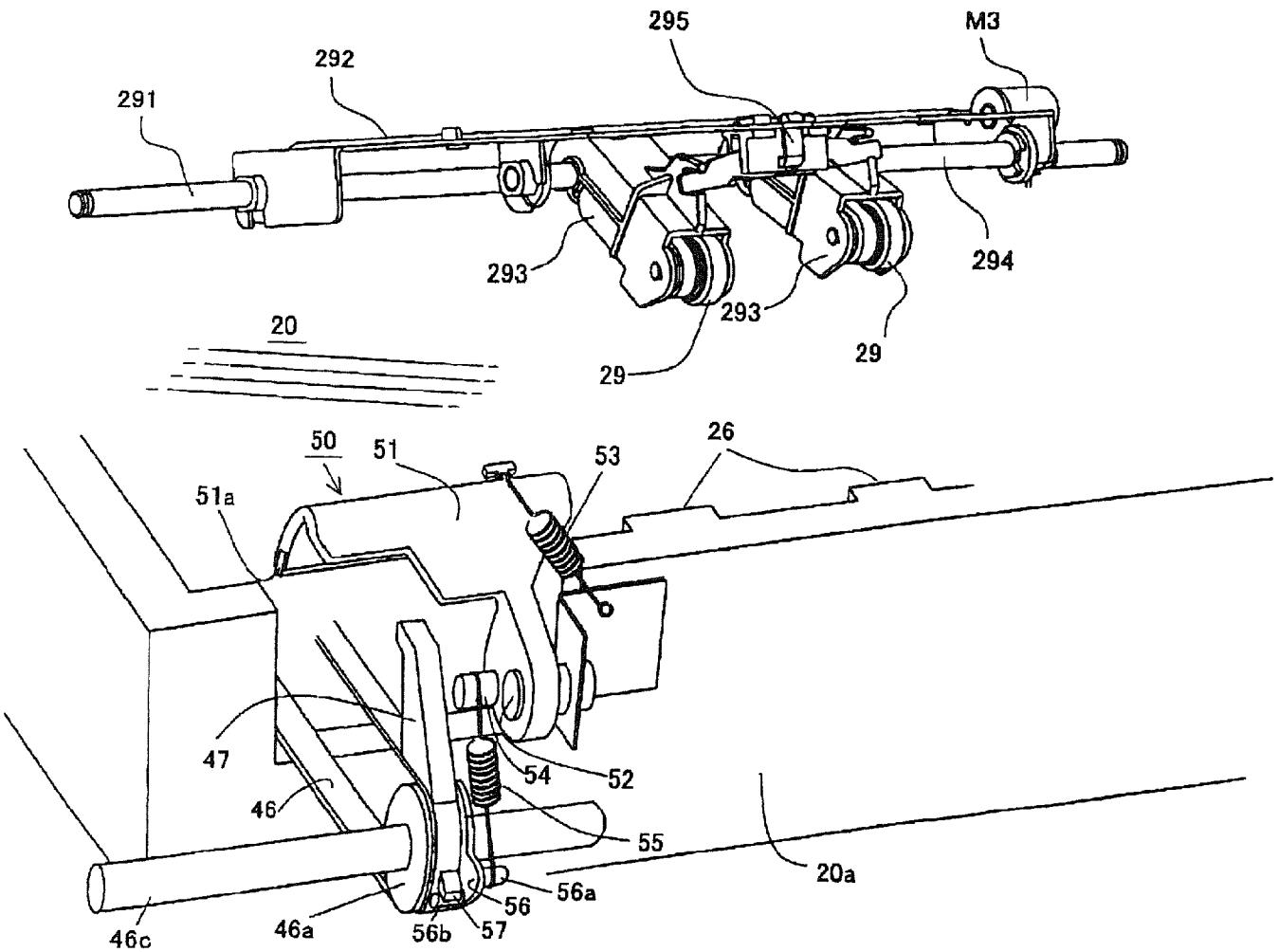
FIG. 2 is a perspective view of key features of a finishing tray from FIG. 1.
Figure 3:
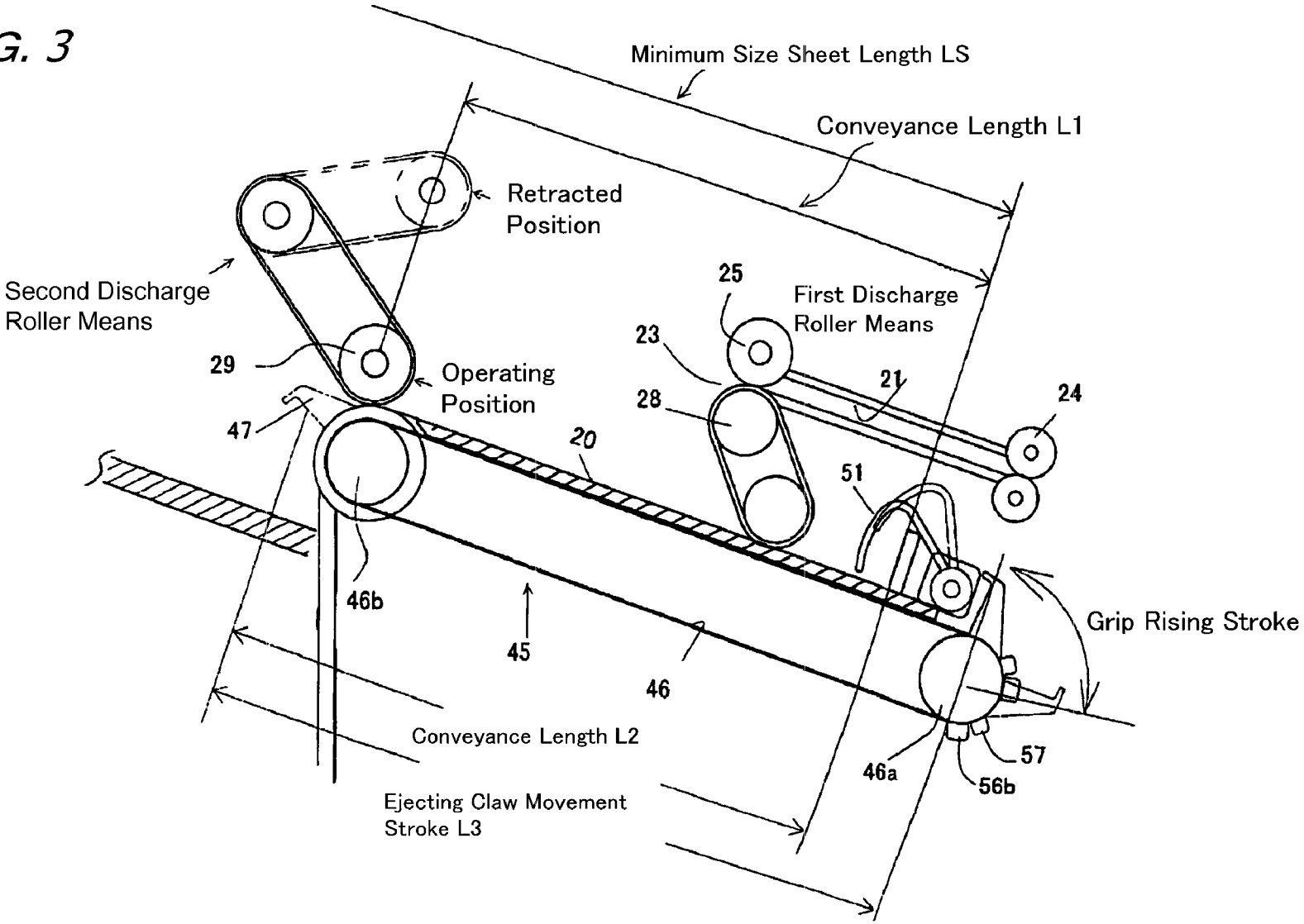
FIG. 3 is an explanatory diagram of dispositional relationships in a storage tray of FIG. 1.

The drawings show the present invention employed in a finishing apparatus (finisher) of an image forming apparatus. FIG. 1 is a view of a layout of the entire configuration; FIG. 2 is a perspective view of key features thereof; FIG. 3 is a view of dispositional relationship in the stacking tray; and FIGS. 4 to 7 are explanatory diagrams of operational states.

As shown in FIG. 1, the invention is attached to an image forming apparatus, for example, to receive sheets formed with images, and employed in a finisher apparatus for finishing sheets stacked in a bundle for each document such as by stapling, punching or stamping. In FIG. 1, an image forming apparatus A is composed of an ordinary printing apparatus, not shown. The printing apparatus forms images on sheets based on original data read by an image reading apparatus or on document data created on a computer. Electrostatic printing, ink-jet printing and silk-screen printing are well known methods of image forming. Composed is an ordinary printer, copier or facsimile apparatus that kicks out a predetermined sheet from a paper cassette installed in the device, prints the sheet with a print head, and discharges the printed sheet from the discharge outlet 10.

The sheet finishing apparatus B of the present invention is connected to a discharge outlet 10 of the image forming apparatus A, for example, to finish printed sheets stacked on a stacking tray 20 such as by stapling or the like, then stacking the finished sheet or sheet bundle (hereinafter referred to as finished sheets) at a storage tray 30. For that reason, a discharge path 21 that leads to the discharge outlet 10 of the image forming apparatus A is installed on the apparatus frame, and a conveyance inlet 22, discharge outlet 23 and sheet conveyance roller 24 are provided at this discharge path 21. A discharge roller 25 (hereinafter referred to as a first discharge roller) that composes a first discharge roller means, described below, is disposed at the discharge outlet 23. A stacking tray 20 composed of a stacking tray is arranged at a downstream side of the discharge outlet 23 forming a level difference. Therefore, printed sheets from the discharge path 21 are conveyed to the stacking tray 20 by the first discharger roller 25.

As shown in the drawing, a storage tray 30 is arranged at a downstream side of the stacking tray 20. A conveyance direction length L1 (see FIG. 3) of the stacking tray is set to be shorter than the length LS of a minimum sheet size. A sheet S fed from the discharge outlet 23 is bridgingly supported by the stacking tray 20 and the storage tray 30. This stacking tray 20 can be configured to a length that is the same as the maximum sheet conveyance direction, but the drawing shows a more compact apparatus made possible by bridgingly supporting sheets along with the storage tray 30. Registration means 26 for aligning the trailing edge positions of sheets is arranged at an upstream side, based on the discharge outlet 23.

Therefore, this configuration allows sheets fed from the discharge outlet 23 to advance in to the center of the stacking tray 20 and sheets conveyed to the tray to switch back so that the trailing edges are positioned at the registration means. The registration means is formed as a projecting wall integrally formed with the tray member that configures the stacking tray 20. Although this configuration engagingly aligns sheet edges at a wall surface of the registration means, it is also acceptable to deploy a separate member to the tray with a structure to advance to and retreat away from the tray. FIG. 2 shows a projecting wall 20*a* integrally formed with the tray to configure the registration means 26. The registration means 26 can be configured to advance to and retreat from the tray due to the relationship with the finishing unit 40. For example, if the finishing unit is a stapler, the registration means can be configured to move to retreat from the tray when stapling sheets. As shown in FIG. 1, the stacking tray 20 is obliquely arranged to facilitate positioning sheets conveyed to the tray at the registration means 26.

A paper guide 27 for guiding a sheet fed by the first discharge roller 25 and a caterpillar belt 28 for guiding the trailing edge of the sheet to the registration means are provided at the discharge outlet 23. The paper guide 27 is supported to pivot vertically at the discharge outlet 23 to guide sheets from the first discharge roller 25 to the tray. One end of the caterpillar belt 28 is pivotally supported. The belt surface on the base end section pressingly contacts the first discharge roller 25 to nip a sheet. The belt surface on the leading edge touches the sheet on the stacking tray and presses it under its own weight. The pulley on the support shaft of the caterpillar belt is connected to a drive motor M1 to convey sheets with the first discharger roller 25 from the discharge outlet to the tray. The leading end of the belt conveys the sheet conveyed to the tray to the registration means 26. Note that a drive motor M1 drives the caterpillar belt 28 at the same time as rotatingly driving the conveyance roller 24, and the first conveyance roller 25 follows the drive of the caterpillar belt 28.

Asecond discharge roller means 29 is arranged above the stacking tray 20, with the following configuration. As shown in FIG. 2, a rotating shaft 291 is axially supported on the apparatus frame, not shown, and a main bracket 292 is supported on the rotating shaft 291 to swing up and down. A raise/lower motor M2 is connected to the rotating shaft 291 of the main bracket 292 via a spring clutch. The main bracket 292 lowers with the forward direction rotation of the motor, and rises with the reverse direction rotation. The spring clutch holds the raised position. A sub-bracket 293 is supported at a drive rotating shaft 294 on the main bracket 292, and at the same time, the sub-bracket 293 is joined to the main bracket by a joint member 295.

Therefore, the sub-bracket 293 is interlocked to the rising and lowering of the main bracket to also rise and lower. The roller 29 is axially supported at the leading end of the sub-bracket 293. A drive motor M3 capable of both forward and reverse drive is installed at the main bracket 292. This motor is configured to belt drive the rollers 29 via drive rotating shaft 294. Two rollers 29 are arranged with a space at the central portion of a sheet. These two rollers compose the second discharge roller means 29. The second discharge roller means 29 is arranged at a sheet conveyance out end of the stacking tray 20, and is configured to move between a position where they touch the uppermost sheet on the tray, and a position retracted therefrom. With a forward rotation along the tray, sheets are moved in a discharge direction, and when rotated in a reverse direction, sheets are moved in a direction opposite to the discharge direction. Also, follower rollers 41 are arranged at positions that oppose the second discharge roller means 29.

The following will explain a mechanism for conveying sheets stacked in the stacking tray 20 (one sheet or a plurality of sheets in a sheet bundle) to the storage tray 30. Sheet transport means 45 for conveying out stacked sheets to the storage tray 30 is arranged at the stacking tray 20. An endless belt 46 that travels along the discharge direction at a backside (lower plate backside) of the stacking tray 20 of the sheet conveying means 45 is trained between the pair of pulleys 46*a* and 46*b*. A claw-shaped sheet ejecting members 47 that projects through the stacking tray 20 engages the trailing edge of the sheets on the tray is integrally mounted to the belt. The sheet ejecting member 47 (hereinafter referred to as the ejecting claw) is arranged in a pair left and right at a width direction of sheets as shown in FIG. 2. Each is integrally formed to the endless belt 46.

Note that the endless belt 46 and the ejecting claw 47 in FIG. 2 are arranged at the left edge side of the sheets, but are also arranged, though not shown, at the sheet right edge side with the same configuration. The ejecting claw 47 moves between its home position (movement stroke L3), shown as a solid line in FIG. 3, to a conveyance out position, shown with the dashed line, a position where it touches the trailing edge of the sheets on the tray and a conveyance out position (sheet conveyance length L2) to push the sheet trailing edges. A drive motor M4 capable of both forward and reverse drives is connected to the pulley 46*a* side on the endless belt 46. Note that the endless belt 46 comprises a gripper raise/lower stroke that back-feeds to move a grip means 50, described below, between an operating position and a non-operating position at the same time as it reciprocatingly moves with the movement stroke L3.

Here, the present invention provides a grip means 50, described below, so that the positions of stacked sheets (the bundle of sheets) on the tray do not move out of alignment when sheets are conveyed in to the stacking tray 20 from the discharge outlet 23 by the first and the second discharge rollers 25 and 29. The grip means 50 is movably established between an operating position where it touches to press and hold an uppermost sheet on the tray, and a non-operating position retracted from the sheet, and moves between both positions according to the conveyance in of the sheets. Shown in the drawing, this is composed of an arm member 51 that moves from the non-operating position above the tray near the registration means to the operating position over the tray.

As shown in FIG. 2, the arm member 51 is swingably supported by the shaft 52 at the sheet trailing edge wall 20*a* (the inner wall composes the registration means 26) integrally formed on the tray, and a rubber friction member 51*a* that touches the sheets is installed to the leading end of the arm member 51. The arm member 51 is constantly urged around the shaft 52 in a clockwise direction by a spring 53 and held at the non-operating position. A pin 54 is embedded in an end portion of axial support side of the arm member 51, and the endless belt 46 pulley 46*a* is interlocked in the following way to the pin 54 via an adjuster spring 55. The drive motor M4 is connected to the pulley 46*a* via a rotating shaft 46*c*, and this rotating shaft 46*c* rotates in the forward and reverse directions with this motor. The pulley 46*a* is fastened to the rotating shaft 46*c*. Therefore, this pulley 46*a* integratingly rotates with the forward and reverse rotation of the rotating shaft 46*c*. Furthermore, a freely rotating pulley 56 that rotates independently to the rotating shaft 46*c* is disposed adjacent to the pulley 46*a*. A fastening pin 56*a* for fastening the other end of the adjuster spring 55 and a follower pin 56*b* that projects to the pulley 46*a* side are integrally formed on the idle pulley 56.

The follower pin 56*b* that engages a cam projection 57 is integrally formed with the belt 46. When the belt 46 back-feeds from the home position shown in FIG. 3 to the direction of the arrow shown in the drawing, the cam projection 57 moves the follower pin 56*b* a predetermined amount around the rotating shaft in the clockwise direction. When the following pin 56*b* is rotated in the clockwise direction with the back-feed of the belt, the adjuster spring 55 is applied with tension, and the arm member 51 rotates in the counterclockwise direction of FIG. 2 around the shaft in resistance to the spring 53, causing an elastic member 51*a* to pressingly hold the uppermost sheet in the tray in the state shown in FIG. 3. A grip control means is provided on the grip means 50 composed of the arm member 51, for controlling movement between the operating position and the non-operating position. The grip control means shown in the drawing is composed of control means of the drive motor M4, and by swinging the arm member 51 around the shaft 52 with the cam projection 57 integrally formed with the endless belt 46, this controls movement between the operating position and the non-operating position. Note that the drive motor M4 is composed of a stepping motor. The control means is pulse-controlled by a control CPU, not shown, of the finisher apparatus B to execute the following operations.

The effects of the invention in the finishing apparatus described above will be explained based on the operating states shown in FIGS. 4 to 7. Initially, a control panel is provided on the image forming apparatus A, and a controller on the apparatus A side selects and sets a finishing mode and discharge mode. For the finishing mode, for example, an execution mode for stapling is selected, and the finisher apparatus stacks sheets in the stacking tray 20. With the discharge mode, the finisher apparatus B conveys sheets from the discharge outlet by the first discharge roller means 25 and the second discharge roller means 29 and stores them in the storage tray 30 via the stacking tray 20. However, a detailed description of that operation will be omitted.

When in a finishing mode, the image forming apparatus issues a job start signal for discharging sheets to the finishing apparatus B, a job end signal to indicate the end of a series of sheets combined in a set, and an execution timing signal for finishing when there is a plurality of finishing modes. The finishing apparatus B is provided an interface with the image forming apparatus A and a discharge sensor Se for detecting a trailing edge of the sheets, arranged at the discharge outlet of the discharge path.

Figure 4A:
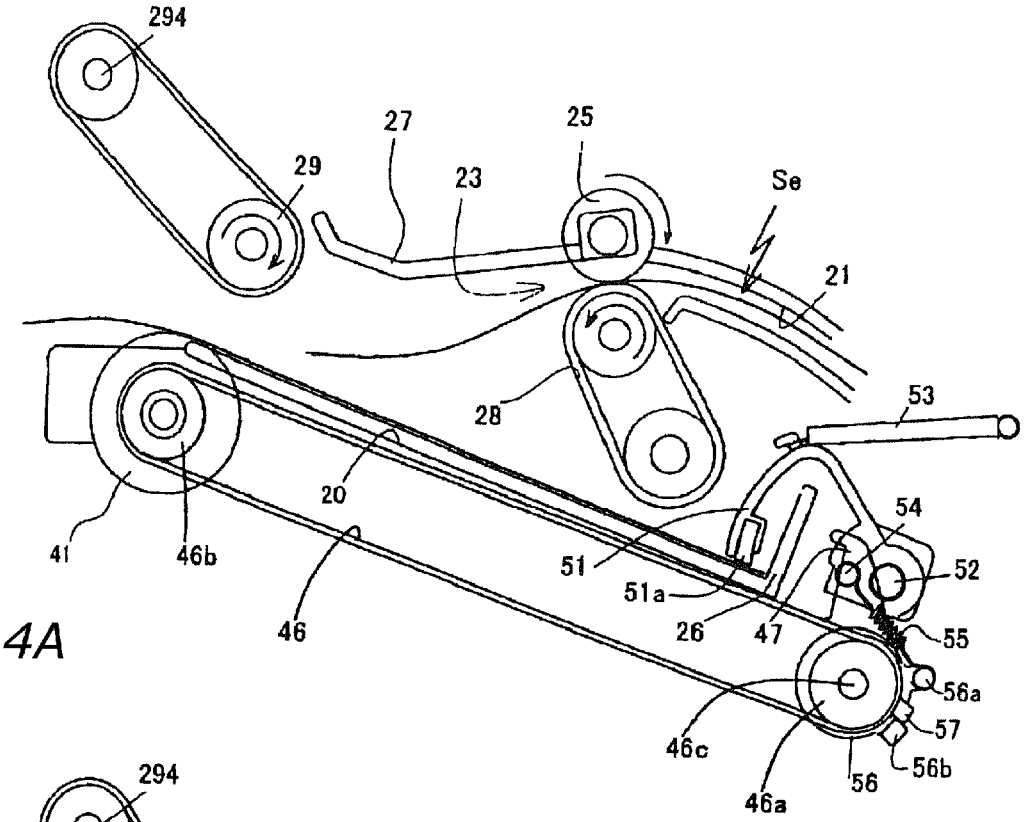
FIG. 4A represents an initial state in which the leading edge of the sheet is being conveyed into the tray.
Figure 4B:
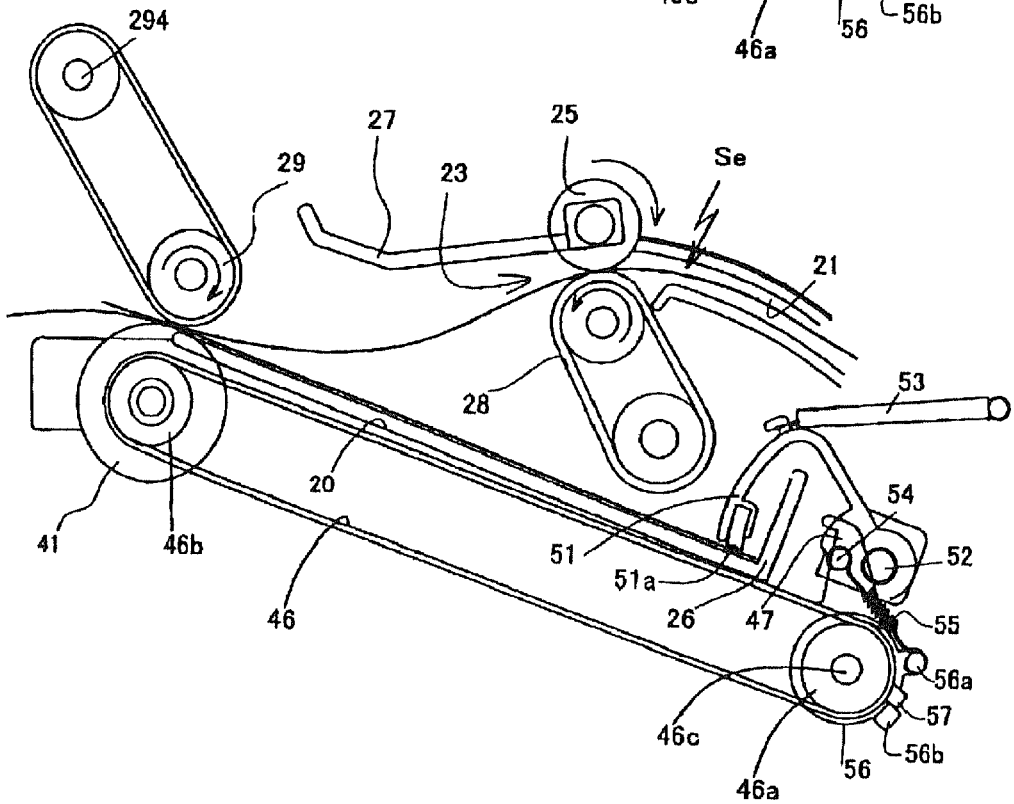
FIG. 4B represents a state in which the leading edge of the sheet is engaging with a second discharge roller means.

FIG. 4A shows a sheet conveyed from the discharge path 21 by the first discharge roller 25. At that time, the second discharge roller means 29 is retracted above the tray by the job start signal or a signal from the discharge sensor Se. In the same way, the endless belt 46 of the sheet ejecting member 47 is set at the home position shown in FIG. 3 by the job start signal. FIG. 4A shows a sheet already stacked on the stacking tray 20. In this state, the endless belt 46 is held at a back-feed position shown in FIG. 3 and the grip means 50 is held at the operating to press the sheets stacked on the tray.

Next, the sheet S kicked out by the first discharger roller 25 is guided by the paper guide 27 and is moved below the second discharger roller 29 on the tray. After an estimated amount of time for the leading edge of the sheet to reach the second discharger roller 29 at a signal from the sensor Se, the main bracket 293 is lowered by the raise/lower motor M2 so the second discharger roller 29 touches the sheet S being fed from the discharge outlet, while rotating in the clockwise direction shown in the drawing by the drive motor M3. At that point, the sheet S is in the state shown in FIG. 4B and is conveyed into the tray while the trailing edge is controlled by the first discharger roller 25 and the leading edge is controlled by the second discharger roller 29. Therefore, the sheet S is supported on the stacking tray 20 and the downstream storage tray 30 without becoming skewed, even if subjected to wind from outside of the apparatus or vibration.

Figure 5A:
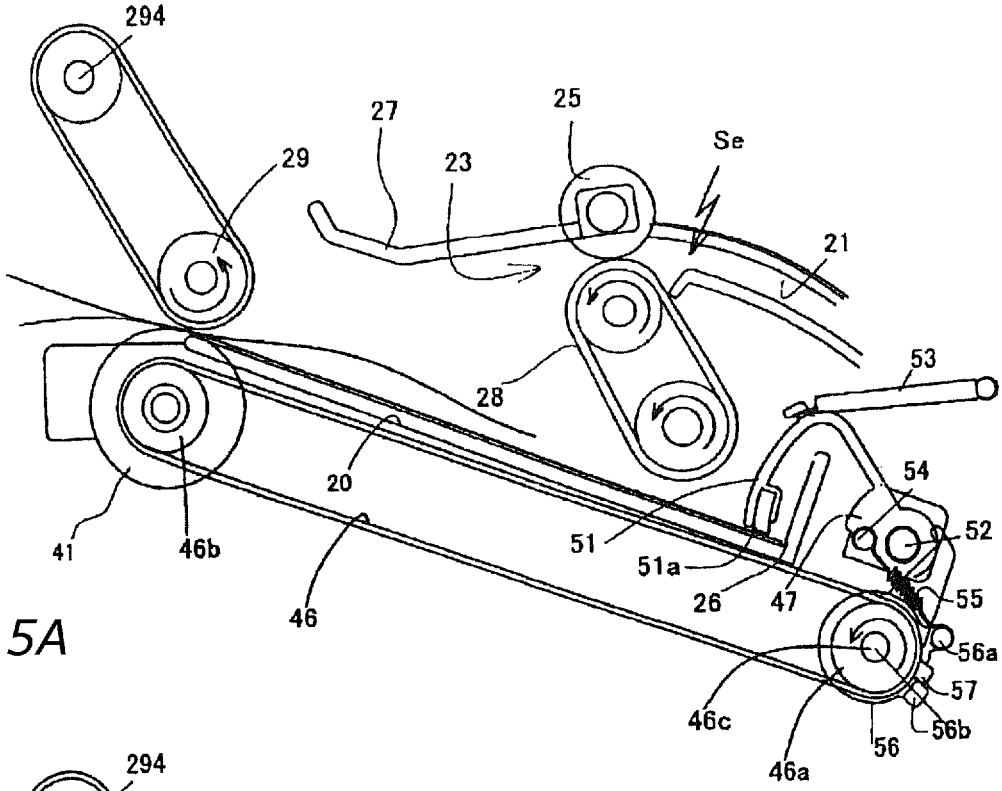
FIG. 5A represents an initial state in which the trailing edge of the sheet has been stored into the tray.

Next, when the trailing edge of the sheet is conveyed out to the stacking tray 20, the drive motor M3 stops at a predetermined time after a signal that the sensor Se has detected the trailing edge of the sheet, and begins to rotate in the counterclockwise direction, as shown in FIG. 5A. At this time, the drive motor M1 of the first discharger roller 25 continues rotating in the discharge direction and the caterpillar belt 28 rotates in the counterclockwise direction of the drawing. Then, the actions of the second discharger roller means 29 and caterpillar belt 28 switch the sheet back and convey it on the tray in a direction opposite to the discharge direction. About the time that the second discharger roller means 29 is rotating in the reverse direction, the drive motor M4 of the endless belt 46 rotates the pulley 46*a* a predetermined amount in the counterclockwise direction of the drawing to return to the home position. The cam projection 57 is separated from the follower pin 56*b* with the return to the home position and the follower pin 56*b* urged by the spring 53 rotates in the counterclockwise direction.

Figure 5B:
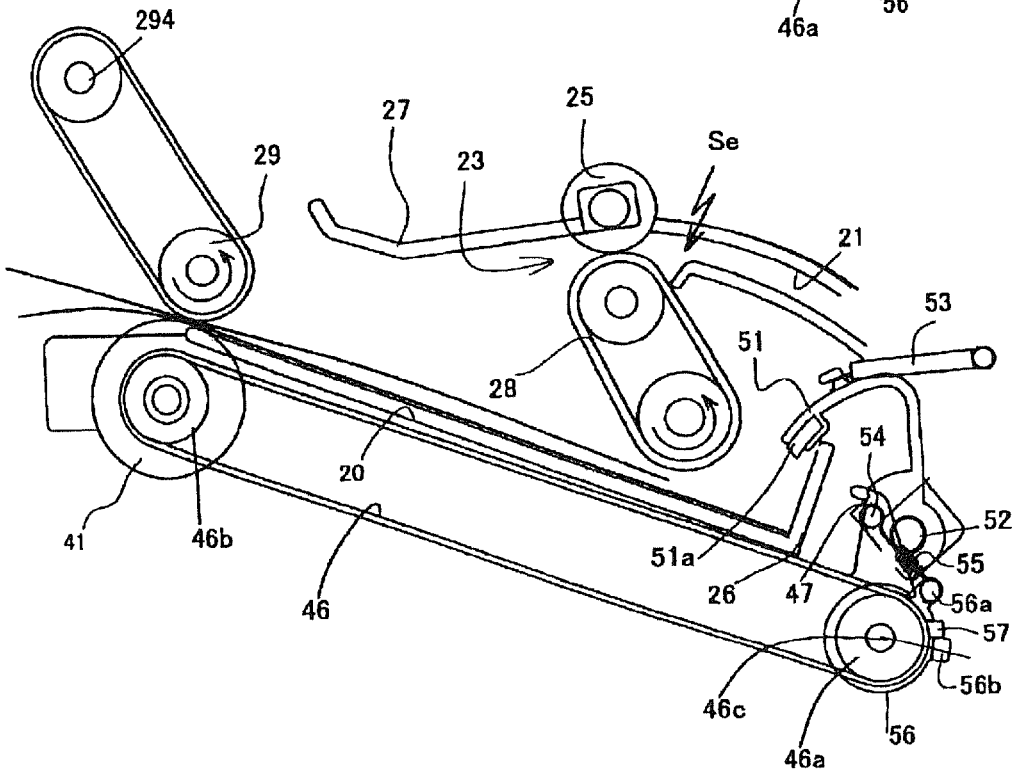
FIG. 5B represents a state in which the sheet stored in the tray is switchback-conveyed.
Figure 6A:
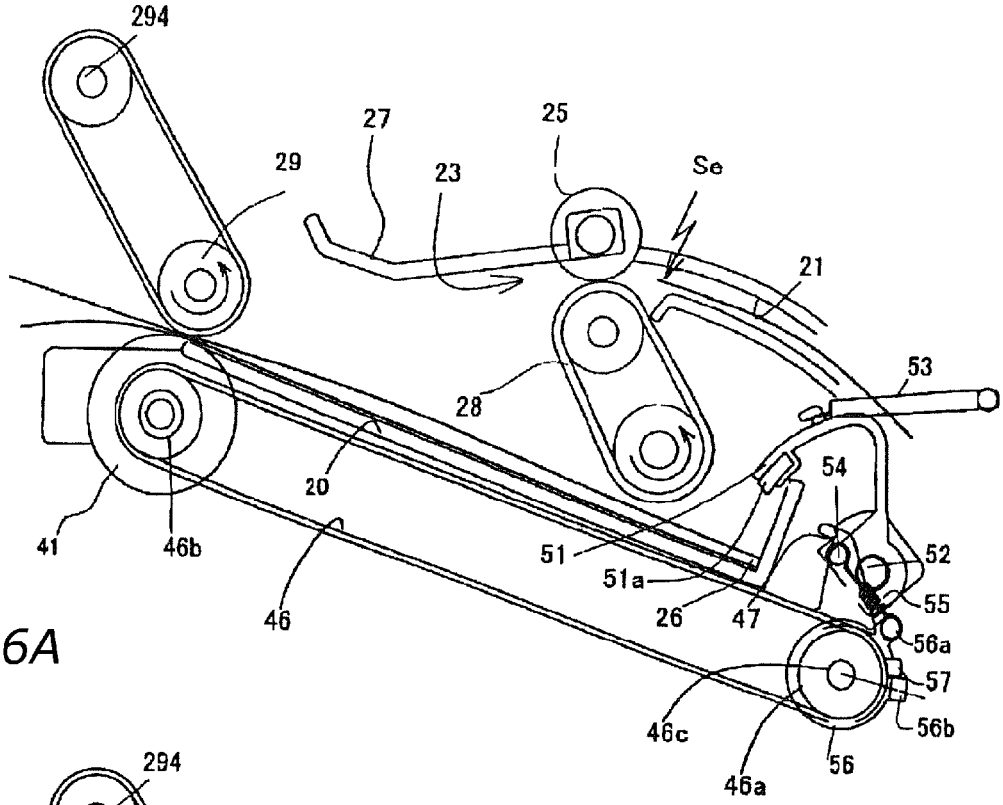
FIG. 6A represents an initial state in which the trailing edge of the sheet being is being positionally registered by a registration means on the tray.

When this occurs, the grip means 50 retracts to a non-operating position above the tray, as shown in FIG. 5B. In this state, the sheet on the tray is back-fed so that its trailing edge engages the registration means 26 for alignment. As shown in FIG. 6A, after the trailing edge of the sheet is aligned by the registration means 26, the second discharger roller means 29 rises to an idling position above the tray from the engaging position on the tray after a presumed amount of time from the sensor Se. At the same time that the raise/lower motor M2 stops, the drive motor M3 stops. About that time, the drive motor M4 of the endless belt 46 back-feeds the pulley 46*a* a predetermined amount in the clockwise direction of the drawing, the second discharger roller means 29 moves to the idling position in the state shown in FIG. 4A, and the grip means 50 moves to the operating position in preparation for a next sheet to be conveyed in the discharge path.

These operations are repeated (the operations of FIGS. 4(*a*) to 6(*a*)) to sequentially stack sheets along the discharge path at the stacking tray 20. With this process, sheets from the discharge outlet are stored in the stacking tray 20 while being controlled by the first and the second discharge roller means arranged upstream and downstream. Therefore, the sheets will not be separated and free from the roller means and will not become skewed or scattered by wind from outside of the apparatus or vibrations. At the same time, sheets that are already stacked in the tray are pressed and held by the grip means 50 so they will not be pushed out of alignment by advancing sheets.

Figure 6B:
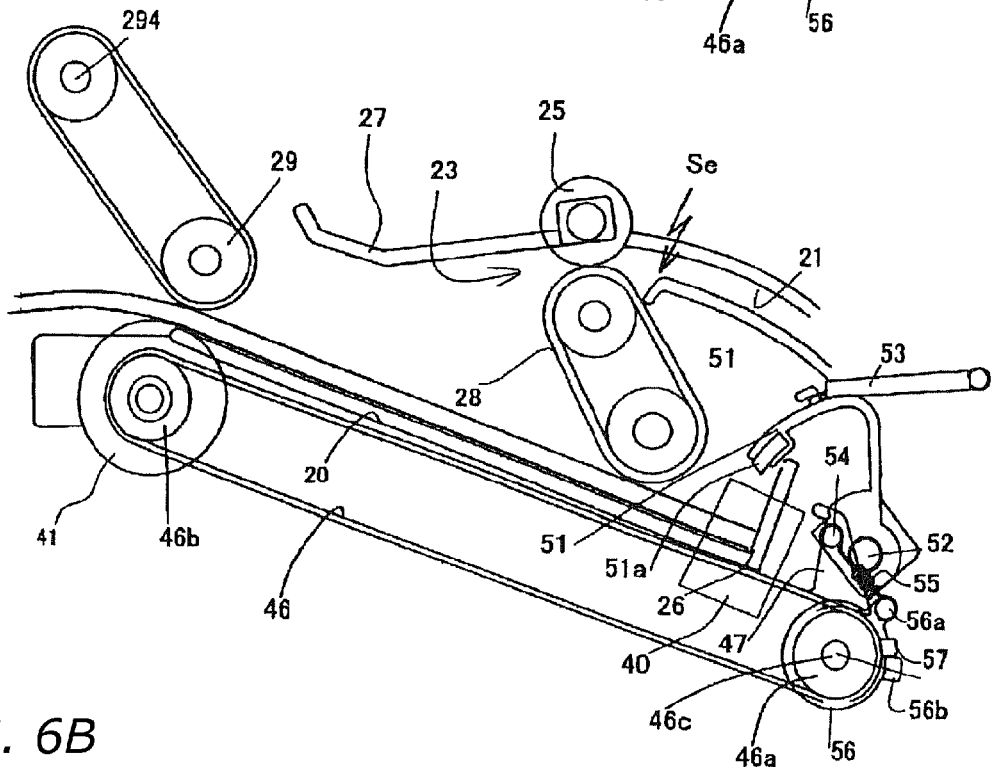
FIG. 6B represents a state in which a process is being implemented on the sheets stacked onto the finishing tray.

Next, a job end signal is received from the image forming apparatus A and the finisher apparatus B executes a process such as stapling, for example. At this time, the grip means 50 is in a position to pressingly hold the sheets which will hinder the finishing operation. The grip means 50 is thus retracted to the non-operating position at the job end signal. In the same way as described above, the endless belt 46 is back-fed from the home position a predetermined amount by the drive motor M4. Again, in the same way, when the registration means is in a position to engage the trailing edge of the sheets and will hinder the finishing operation, the registration means 26 are retracted. The retracting mechanism can provide registration means on the finishing unit 40, such as a stapler, not shown, or the alignment means can be configured to retract in conjunction with the finishing unit 40. FIG. 6B shows the finishing unit 40 for stapling. The stapling device moves along the trailing edge of the sheet bundle stacked on the stacking tray 20. The unit embedded with staples and a drive cam is supported on a guide rail to move along the trailing edge of the sheets to staple a predetermined position of the sheets.

Figure 7A:
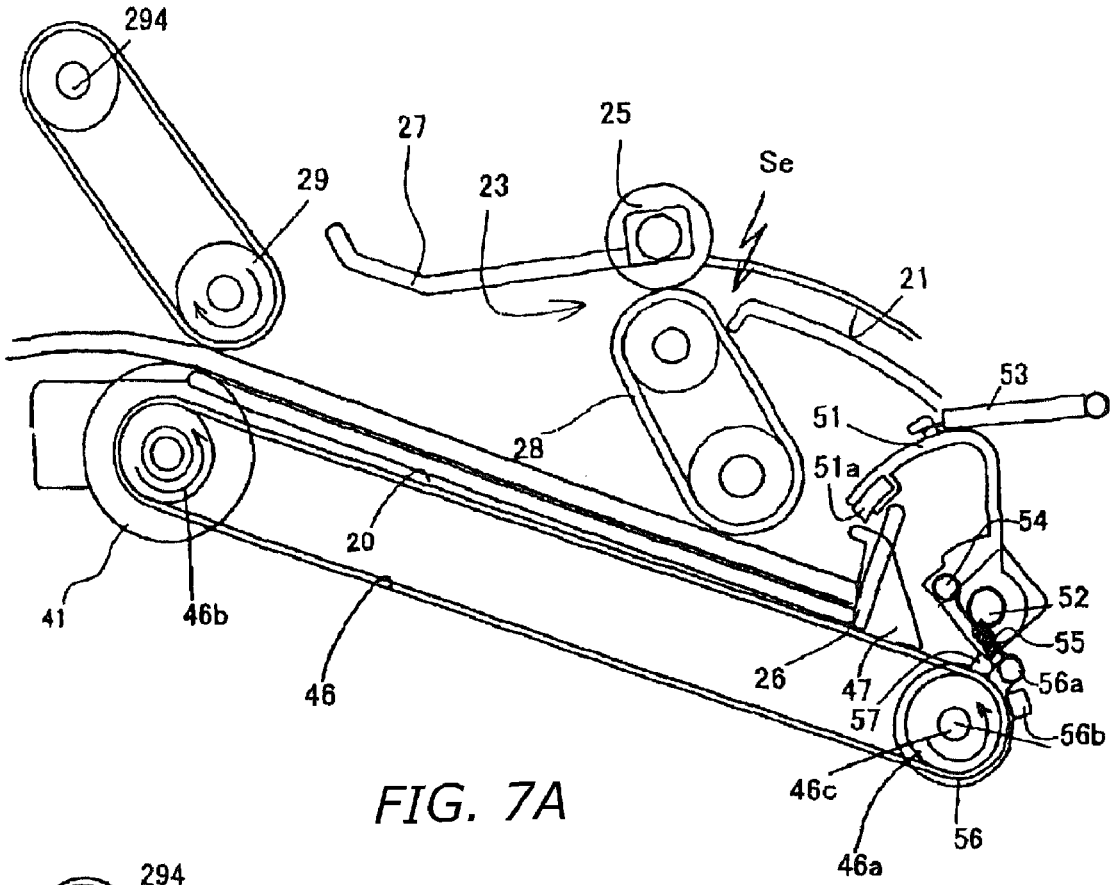
FIG. 7A represents a conveying-out initial state in which a sheet transport means has engaged the trailing edge of the sheet.
Figure 7B:
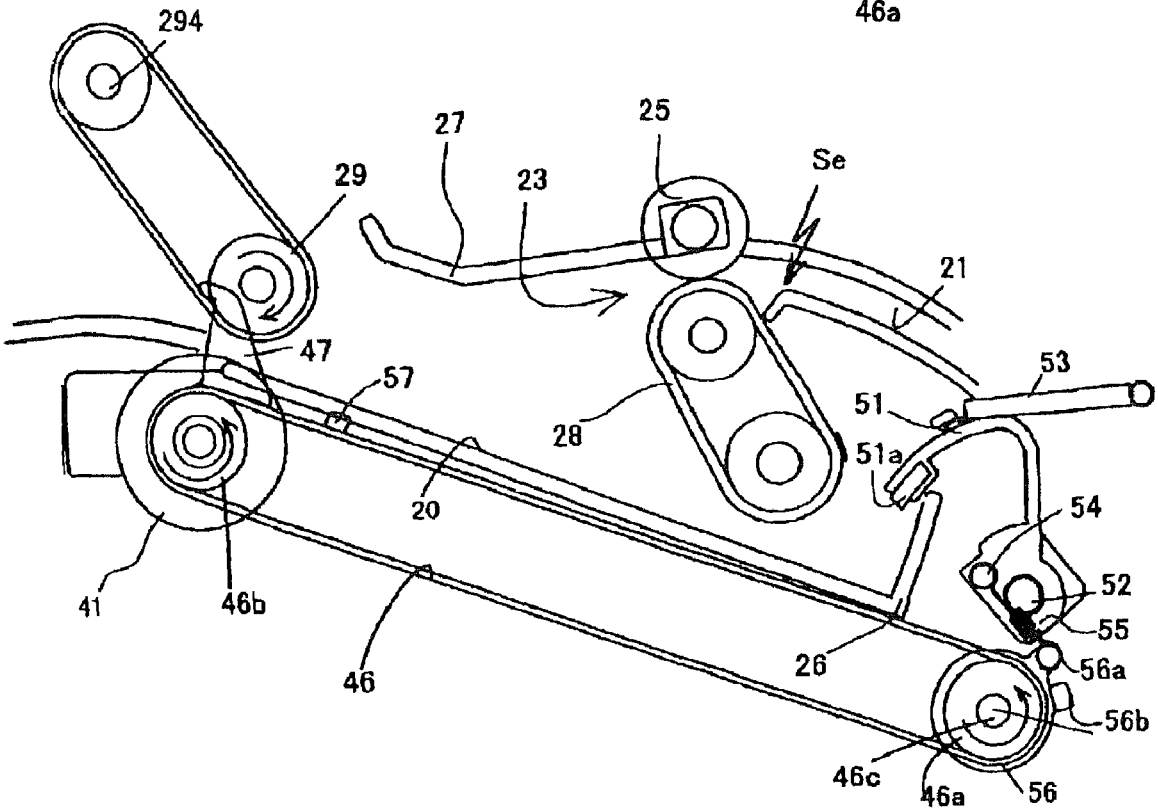
FIG. 7B represents a state in which the sheet is being conveyed out to the storage tray.

Next, when the predetermined process is completed by the finishing unit 40, the finisher apparatus B drives the drive motor M4 at the end signal to move the endless belt 46 from the home position to the conveyance out position. FIG. 7A shows the sheet ejecting member 47 of the belt 46 engaging the trailing edge of the sheet on the tray and the grip means 50 is retracted to a non-operating position. When the belt 46 moves from this state to the left direction of the drawing, the sheet ejecting member 47 moves the finished sheets (bundle) toward the storage tray 30. After the finished sheets are conveyed as shown in FIG. 7B, the endless belt 46 recovers to its home position.

Figure 8:
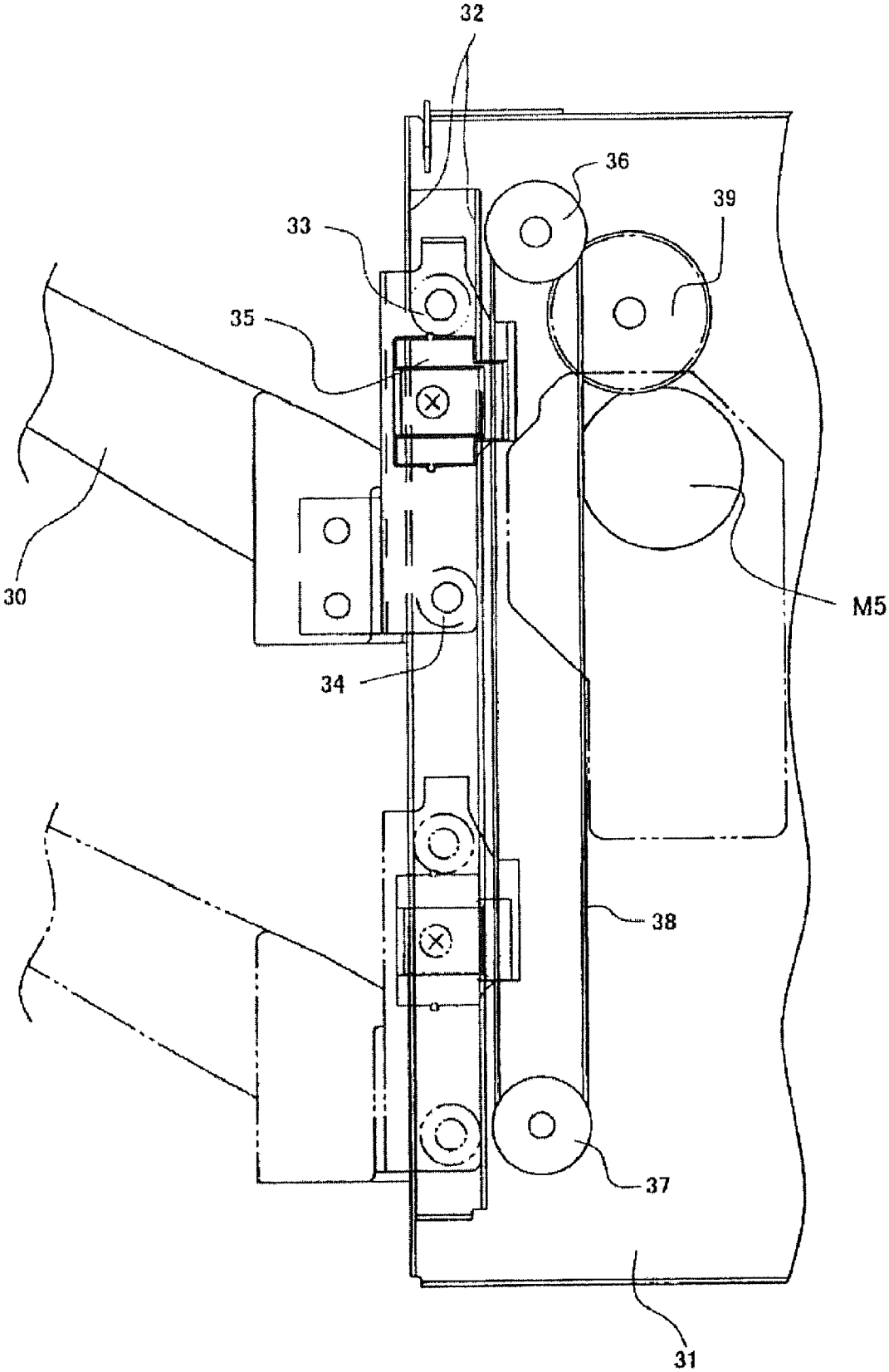
FIG. 8 is an explanatory diagram of a raise/lower mechanism for the storage tray.

The structure of the storage tray 30 will be explained below with reference to FIG. 8. The storage tray 30 is mounted allowing it to rise/lower in the vertical direction on the apparatus frame 31 and the raise/lower is controlled to position the uppermost surface of a stacked sheet at the sheet conveyance out edge of the stacking tray 20. Guide rails 32 are provided at a sheet stacking direction on the apparatus frame 31, and rollers 33 and 34 that fit on the guide rails 32 are mounted to a fastening member 35 of the storage tray 30.

Therefore, the storage tray 30 is rise/lower supported along the guide rails 32 by the rollers 33 and 34 integrated with the storage tray 30. A vertically disposed pair of pulleys 36 and 37 and a raise/lower belt 38 trained between the vertical pair of pulleys 36 and 37 are provided on the apparatus frame 31, and a portion of the fastening member 35 of the raise/lower belt 38 is fastened to the apparatus frame 31. A raise/lower motor M5 is connected by a driving gear 39 to one of the pulleys 36 and 37 to raise and lower the storage tray 30 in the vertical direction of the drawing.

An upper limit sensor (not shown) is mounted above the storage tray 30. The raise/lower motor M5 gradually lowers the storage tray 30 according to the amount of sheets stacked so that the uppermost sheet of the storage tray 30 is positioned at the upper limit sensor position, and rises so that the upper surface of the tray is at the upper limit sensor position when sheets are taken from the storage tray 30. Note that it is also acceptable for the storage tray 30 not to be free to rise/lower in the vertical direction as described in relation to the present invention, but to be fastened to the apparatus frame 31.

The present invention is described based on a preferred embodiment of the drawings provided. An example was provided for controlling the movement of the grip means 50 between an engaging position (or operating) and a non-engaging (or non-operating) position, with a cam projection provided on the endless belt 46, as described in relation to FIG. 2. However, it is also acceptable to connect to the drive motor M4 with a power train via a clutch. Furthermore, a different drive source than the drive motor M4, such as a solenoid drive source is also perfectly acceptable. The grip means 50 is arranged in two positions left and right to engage the left and right edges of the sheets on the stacking tray 20, but it is also possible to arrange the grip means 50 in one, central location of the sheets. In this case, for example, it is preferable to arrange the second discharge roller means 29 spaced at two locations at a center of the sheets, and to arrange the grip means 50 at a center position of the roller means so that sheets do not become wrinkled. When controlling side edges of sheets on the stacking tray using a side edge guide, etc., the means should be disposed at positions where the sheets on the stacking tray are not wrinkled or otherwise damaged, according to the state of the sheets on the stacking tray. As an example, it is possible to dispose the grip means 50 at another side edge of the sheets not being guided or controlled.

As described above, with the sheet finishing apparatus of the present invention, grip means is provided for pressingly holding sheets stacked on a tray move between an operating position to engage the sheets, and a retracted, non-operating position in a configuration for conveying sheets out from a discharge outlet to a tray by a first discharge roller means arranged in a discharge path and a second discharge roller means arranged at a stacking tray. Therefore, sheets conveyed in from the discharge outlet to the stacking tray are conveyed to a predetermined position while being controlled by the first discharge roller means of the discharge outlet and the second discharge roller means of the tray. For that reason, the conveyed sheet is neither skewed nor scattered to outside the tray, and at the same time, sheets already stacked (a sheet bundle) are held by the grip means and do not come out of their proper alignment because of a conveyed sheet. Therefore, sheets are stacked with the correct posture at a predetermined position on the stacking tray, which enables accurate subsequent stapling or other finishing processes. By composing the second discharge roller means disposed of a forward and reverse rotating roller at the stacking tray, and restrainingly holding stacked sheets using grip means when switching back and storing sheets from the discharge outlet to the stacking tray, a superior effect of making it possible for accurate finishing without the stacked sheets coming out of alignment is attained.

This application claims priority rights from Japanese Pat. App. No. 2005-379992, which is herein incorporated by reference.

What is claimed is:

1. A sheet finishing apparatus comprising:

a discharge path along which sheets are sequentially conveyed out from a discharge outlet;

a first discharge roller means disposed in said discharge path, for discharging sheets from the sheet-discharge outlet;

a stacking tray into which sheets from the discharge outlet are stacked and stored, said stacking tray disposed below the discharge outlet and forming a break in the discharge path;

a second discharge roller means disposed on said stacking tray, for conveying, in cooperation with said first discharge roller means, sheets downstream in the sheet-discharge direction;

a raise/lower support means for supporting said second discharge roller means allowing it to rise and lower between an engage position in which said second discharge roller means engages a sheet on said stacking tray, and a retract position;

registering means disposed on said stacking tray, for positionally registering the conveyance-direction trailing edge of the sheets;

grip means, disposed on said stacking tray, for pressingly holding an uppermost stacked sheet, said grip means configured to allow it to shift into an operational position, in which said grip means engages the uppermost sheet, and to shift from the operational position into a non-operational position into which said grip means is retracted;

a sheet ejecting member disposed on said stacking tray free to reciprocate back and forth along said stacking tray, for conveying finishing-processed sheets out of said stacking tray to a storage tray downstream therefrom, said sheet ejecting member being furnished with a linked-movement mechanism for linking with said grip means so as to engage the trailing edge of a sheet to transport the sheet, after said sheet ejecting member in the course of its reciprocating movement shifts said grip means from the operational position into the non-operational position; and a sheet finishing means for implementing processes including stapling on sheets positionally registered by said registering means.

2. The sheet finishing apparatus according to claim 1, wherein:

said registering means is disposed upstream of the discharge outlet in the discharge direction, so as to positionally register the trailing edges of the sheets on said stacking tray;

said second discharge roller means is composed of a forward- and reverse-rotating roller means disposed in a position to engage the leading edge of sheets conveyed from the discharge outlet into the midportion of the stacking tray; and said forward- and reverse-rotating roller means by rotating in one direction cooperates with said first discharge roller means to convey sheets out from the discharge outlet to said stacking tray, and by rotating in the opposite direction transports the trailing edge of the sheet toward said registering means.

3. The sheet finishing apparatus according to claim 1, further comprising a sensor means for detecting the leading edge of a sheet in the discharge path; therein being configured in such a way that said second discharge roller means is controlled to shift from the retract position to the engage position with a sheet detection signal from the sensor means as a referent, and the grip means is controlled to shift from the operational position to the non-operational position at a predetermined time after said second discharge roller means has shifted into the retract position.

4. The sheet finishing apparatus according to claim 1, wherein:

said sheet ejecting member is composed of an endless belt disposed along said stacking tray, a sheet-engaging claw member linked with said endless belt, and a forward-and-reverse drive motor that reciprocates the endless belt at a predetermined stroke; and said linked-movement mechanism is provided on said endless belt and is arranged so as to control the shifting of said grip means between the operational position and the non-operational position at a reciprocation stroke that differs from the reciprocation stroke at which said sheet-engaging claw member engages the edge of a sheet on said stacking tray to transport the sheet.

* * * * *